US005131646A

United States Patent [19]

Balow

[11] Patent Number: 5,131,646

[45] Date of Patent: Jul. 21, 1992

[54] PRINTING PRESS WITH MOVABLE FLY

[75] Inventor: Frank A. Balow, Western Springs, Ill.

[73] Assignee: Rockwell International Corporation, El Segundo, Calif.

[21] Appl. No.: 746,845

[22] Filed: Aug. 19, 1991

[51] Int. Cl.[5] ..... B65H 29/00

[52] U.S. Cl. ..... 271/187; 271/315; 198/584; 198/861.6

[58] Field of Search ..... 271/83, 187, 315; 198/583, 584, 861.6

[56] References Cited

U.S. PATENT DOCUMENTS

| | | | |
|---|---|---|---|
| 3,904,192 | 9/1975 | Pfeifer et al. | 271/187 |
| 4,088,314 | 5/1978 | Phillps | 271/187 |
| 4,334,673 | 6/1982 | Clifton | 271/187 |
| 4,709,820 | 12/1987 | Jenkins et al. | 271/187 |
| 4,718,655 | 1/1988 | Okayama et al. | 271/187 |

*Primary Examiner*—Robert P. Olszewski
*Assistant Examiner*—Steven M. Reiss
*Attorney, Agent, or Firm*—C. B. Patti; V. L. Sewell; H. F. Hamann

[57] ABSTRACT

A printing press (10) having a delivery fly (12) having a plurality of laterally adjustable arcuate fingers (32) mounted on a shaft (34) and defining a plurality of pockets (33) extending peripherally around the fly (12) to receive a printed article (A) in the pockets (33). The press (10) has a device (42) for rotating the shaft (24), and a belt (18) for moving the articles (A) to a position (14) adjacent the pockets (33) of the fly (12) for depositing the articles (A) in the pockets (33), and a belt (26) for receiving the articles (A) from the pockets (33) of the fly (12), and for transporting the articles (A) away from the fly (12). The press (10) has a hinge (58) for moving the fly (12) to a position away from the belt (18) to provide access to the pockets (33).

12 Claims, 3 Drawing Sheets

PRINTING PRESS WITH MOVABLE FLY

BACKGROUND OF THE INVENTION

The present invention relates to printing presses.

In printing presses, a common device of delivering the cut and folded product, such as a signature or book, at the end of the press is through the use of a delivery fly. This delivery fly is also commonly known as a fan, a fly fan, or bucket arrangement. The fly usually comprises several wheels driven on a common shaft, with the fly having pockets formed by fingers arranged around the wheel. The cut and folded products are deposited or inserted into the pockets one at a time, and, in turn, the products are stripped or removed from the fly onto a slow moving delivery belt transport in an overlapping or shingled fashion. Hence, the purpose of the fly is to take high speed products, slow them down, and deposit them onto the delivery belt for further processing.

It is a common occurrence for product jams to take place in the area of the fly, either at the entrance point or exit point. The jams occur for a variety of reasons, and may be caused by events that happen significantly in advance of reaching the fly area. Since the fly area is the point where the major speed change is imparted to the products, it becomes a spot where the jams are most likely to result.

These jams may or may not cause damage to the press, but, in any event, the jam is likely to be a problem to clear out in order that the press can be restarted. Clearing the jam is difficult because of the restricted space involved, and the longer it takes to get the press restarted the less productive the press becomes.

SUMMARY OF THE INVENTION

A principal feature of the present invention is the provision of an improved printing press of simplified construction.

The printing press of the present invention comprises, a delivery fly having a plurality of arcuate fingers mounted on a shaft and defining a plurality of pockets extending peripherally around the fly to receive a printed article in the pockets. The press has means for rotating the fly shaft, first means for moving the articles to a position adjacent the pockets of the fly for depositing the articles in the pockets, and means for receiving the articles from the pockets of the fly, and for transporting the articles away from the fly.

A feature of the present invention is the provision of a second means for moving the fly to a position away from the first moving means to provide access to the pockets.

Thus, a feature of the present invention is that the fly is moved into a position where access is easily obtained to the pockets in the fly in order to clear a jam in the fly.

Another feature of the present invention is that the jam may be cleared in a simplified manner.

Yet another feature of the invention is that the movable delivery fly significantly reduces the time expended in clearing jams from the press in order to increase the amount of time the press is operating.

Thus, a feature of the present invention is that the movable fly minimizes down time of the press.

Yet another feature of the invention is that the movable fly is of simplified construction.

Further features will become more fully apparent in the following description of the embodiments of this invention, and from the appended claims.

DESCRIPTION OF THE PREFERRED EMBODIMENTS

Figure 1:
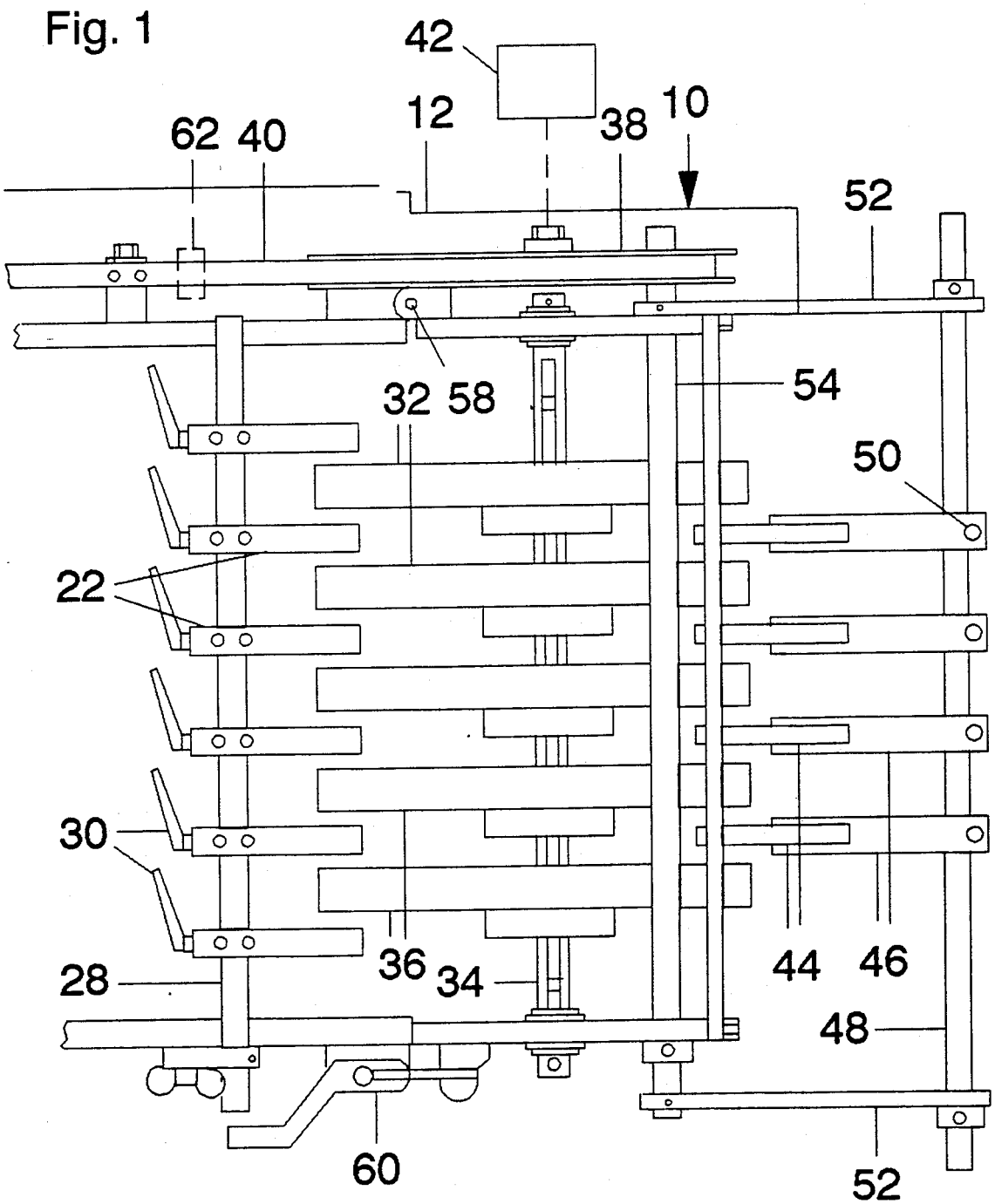
FIG. 1 is a plan view of a press of the present invention with a fly structure in an operative position.
Figure 2:
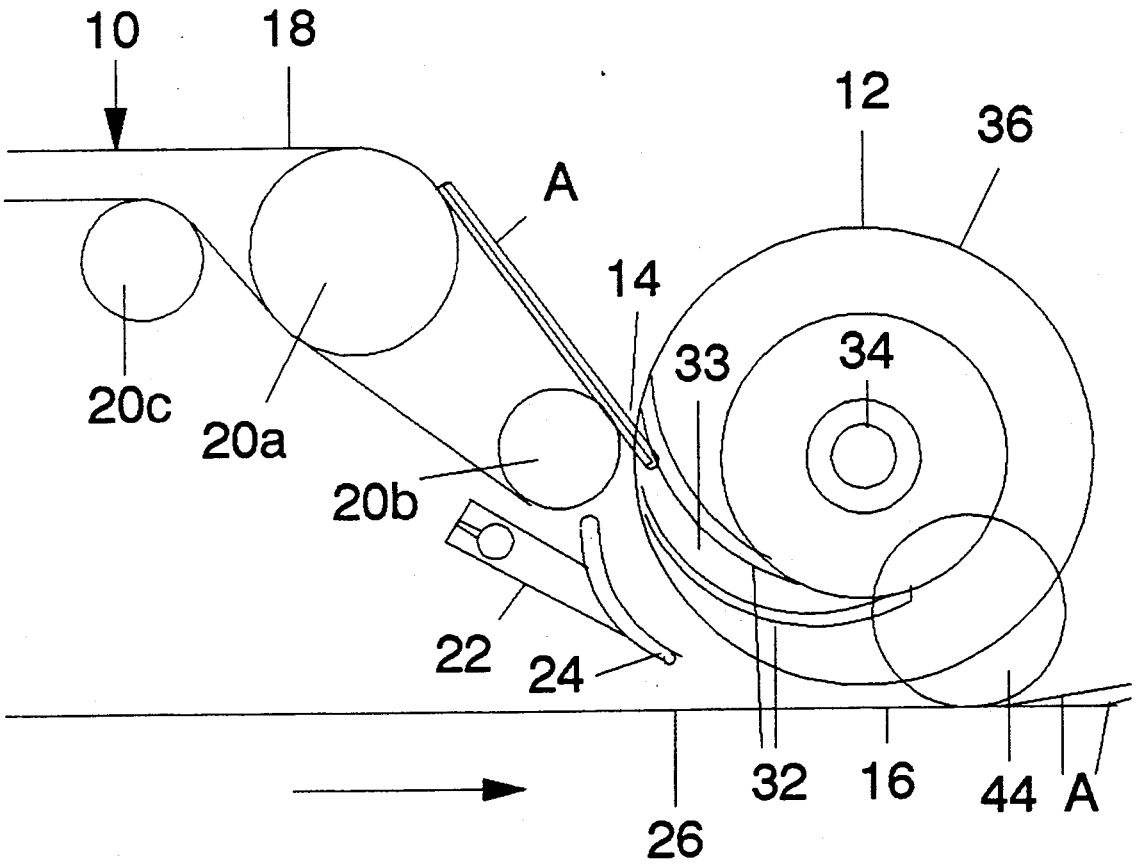
FIG. 2 is a side elevational view of the press of FIG. 1.

Referring now to FIGS. 1 and 2, there is shown a printing press generally designated 10 having a fly arrangement or structure 12 for moving a folded article or product, such as a signature or book, from a first location 14 in the press 10 to a spaced second location 16 in the press 10.

The press 10 has a first endless delivery belt 18 passing around a plurality of driven rollers 20*a*, 20*b*, and 20*c* in order to move the folded product or articles A from a folding portion of the press 10 after printing of the articles A to the first location 14 adjacent the fly 12. As shown, the press 10 has a plurality of shoes 22 having a depending arcuate arm 24 extending around a lower portion of the periphery of the fly 12, and spaced slightly above a second endless delivery belt 26. The shoes 22 are mounted on a laterally extending bar 28, and the shoes 22 have an associated clamp 30 in order to lock the shoes 22 at a desired lateral spaced position along the bar 28.

The fly 12 has a plurality of arcuate fingers 32 extending peripherally around a shaft 34, and being mounted on the shaft 34 at a fixed position, with the fingers 32 defining a plurality of pockets 33 around the shaft to separately receive the articles A. As shown, the fly 12 has a plurality of sets 36 of the fingers 32 at a desired lateral location on the shaft 34, with each of the sets 36 being located intermediate the shoes 22 of the press 10. The fly 12 has a drive pulley 38 secured to one end of the shaft 34, and being driven by an endless belt 40 which in turn is driven by a suitable motor 42.

As shown, the press 10 has a plurality of stripper wheels 44 rotatably mounted in a plurality of retaining members 46 which are secured at spaced lateral locations along a bar 48. The retaining members 46 supporting the wheels 44 are laterally adjustable along the bar 48 by suitable locking bolts 50, and, as shown, the stripper wheels 44 are located intermediate the sets 36 of the fly 12. The bar 48 is mounted on the fly arrangement 12 through the use of a pair of spaced arms 52 which are secured to a shaft 54 of the fly arrangement 12. The wheels 44 and bar 48 are also adjustable vertically relative to the delivery belt 26 to exert a desired compression force against the belt 26.

The delivery belt 26 is driven by a suitable motor 56 in a direction away from the shoes 22, as indicated by the direction of the arrow in the drawing. The stripper wheels 44 engage the articles A in the pockets 33, and facilitate their removal from the pockets 33 into an overlapping or shingled relationship on the delivery belt 26.

Thus, in operation, the printing press prints and folds the articles A, and passes the articles A on the first belt 18 in a direction toward the fly 12, in order to separately insert the articles A into the pockets or recesses 33 of the fly 12 at the first location 14, at which time the articles A leave the first belt 18 and pass into the fly 12. As the fly 12 rotates in an angular direction, as indicated by the arrow on the drawings, the articles A are moved from the first location 14 to the second location 16 adjacent the belt 26. In turn, the stripper wheels 44 remove the articles A from the pockets 33, and deliver them to the belt 26 in an overlapping or shingled relationship, with the belt 26 passing the articles A in a downstream direction relative to the fly 12 for further processing, as desired.

During operation of the press, the fly 12 takes the high speed articles A from the first belt 18, slows the articles A down, and deposits the articles A onto the delivery belt 26 for further processing. However, it is a common occurrence for the articles to jam in the area of the fly 12, either at the entrance point 14 or the exit point 16 of the press 10. Hence, since the fly area is the point where the major speed change is imparted to the articles A, the fly area becomes the spot where the jams are most likely to result. Due to the confined space adjacent the fly 12, it is difficult to clear out the jam while the press 10 is inactivated, after which the press 10 may be restarted resulting in significant down time of the press 10.

In accordance with the present invention, the fly arrangement 12, including its shaft 54 and bar 48 retaining the stripper wheels 44, has a hinge 58 pivotally mounting the fly arrangement 12 in the press 10. The press 10 also has a suitable clamp 60 adjacent one side of the fly arrangement 12 in order to releasably lock the fly arrangement 12 in a first position of the fly arrangement 12 adjacent the first belt 18 and shoes 22 in an operative position of the press 10. However, when the clamp 60 is open, the fly arrangement 12 may be pivoted on the hinge 58 to a second spaced position, as shown on FIG. 3, away from the location of the first belt 18 and shoes 22 in order to provide access to the fly 12 and pockets 33, such that the jam may be cleared in a simplified and rapid manner. As shown, the stripper wheels 44 are also moved to the second remote position along with the fly 12. Once the articles A causing the jam have been removed from the fly arrangement 12 or adjacent the belt 18 and shoes 22, as the case may be, the fly arrangement 12 is pivoted from the second remote position back to the original operative position adjacent the belt 18 and shoes 22, after which the clamp 60 is utilized to lock the fly arrangement 12 in place on the press 10.

Thus, in accordance with the present invention, the printing press 10 has a fly arrangement 12 which may be moved between a first operative position adjacent the belt 18 and shoes 22 to a second remote position located away from the first belt 18 and shoes 22 in order to facilitate the removal of articles A from the press 10 during a jam in a simplified and rapid manner. Of course, the fly arrangement 12 may be constructed to be moved to a remote second position in any other suitable manner, such that the fly 12 may be moved to either side, or up or down positions relative to the first belt 18 and shoes 22, or the printing press 10 may have a suitable device to slide the fly 12 away from the belt 18 and shoes 22 in order to provide access to the pockets 33 of the fly 12.

Figure 3:
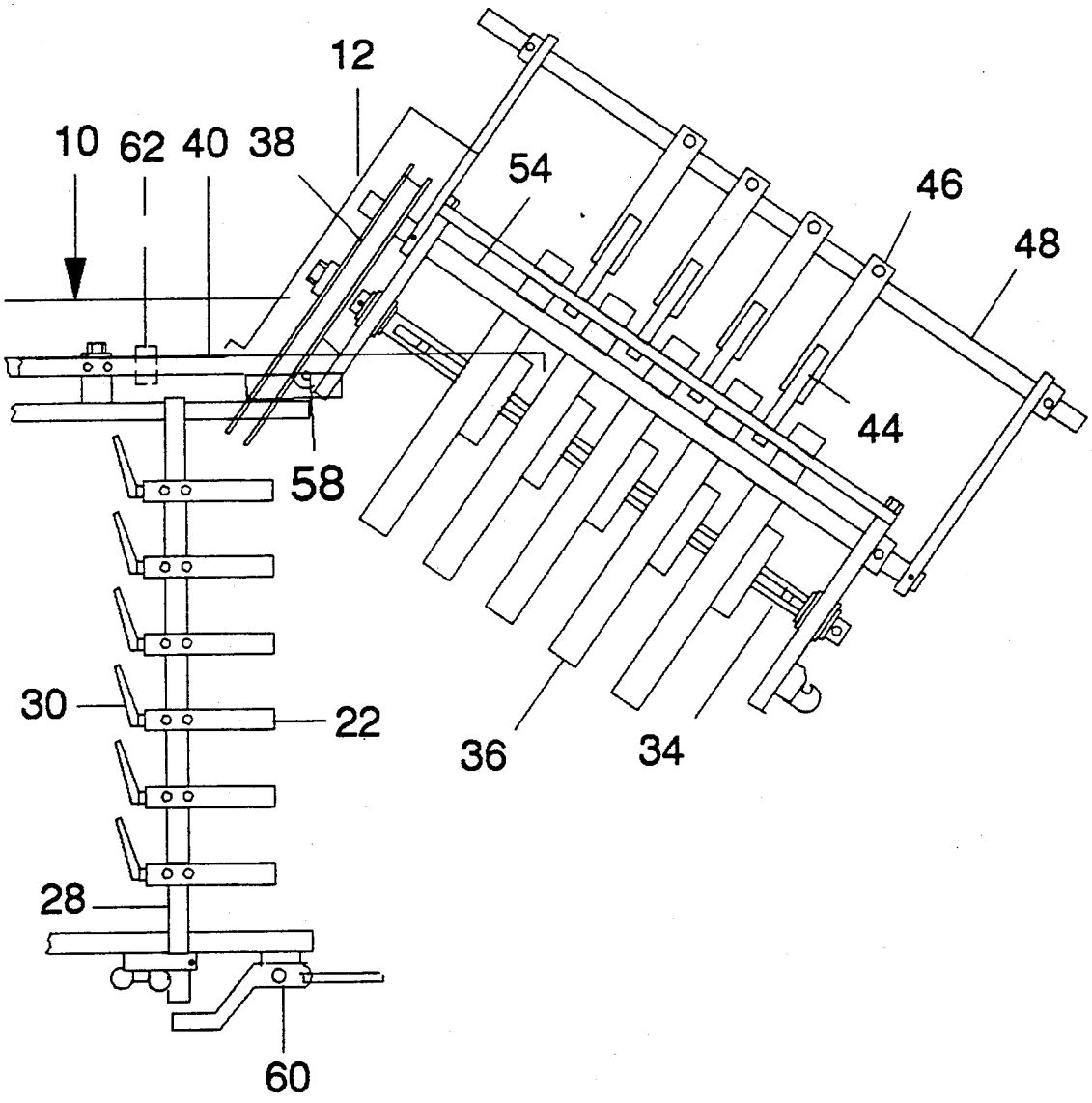
FIG. 3 is a plan view illustrating the fly structure of the press moved to a remote position in the press.

As shown in FIG. 3, when the fly 12 is pivoted to its second remote location, the press 10 has a plurality of keepers 62 located over the belt 40 which drives the fly 12 in order to retain the belt 40 in place while the press 10 has been stopped in the second remote location of the fly 12, and in order to prevent dislodgement of the belt 40 from the pulley 38 and maintain the timing of the fly 12 and the printing press 10 in the region of the fly 12.

In addition to providing access to the fly 12 during a jam, the fly arrangement 12 also assists the operator in maintenance and service operations of the press in the region of the fly 12.

The foregoing detailed description has been given for clearness of understanding only, and no unnecessary limitations should be understood therefrom, as modifications will be obvious to those skilled in the art.

What is claimed is:

1. A printing press, comprising:

a delivery fly having a plurality of arcuate fingers mounted on a shaft and defining a plurality of pockets extending peripherally around the fly to receive a printed article in the pockets;

means for rotating the fly shaft;

first means for moving the articles to a position adjacent the pockets of the fly for depositing the articles in the pockets;

means for receiving the articles from the pockets of the fly, and for transporting the articles away from the fly; and second means for permitting movement of the fly to a position away from the first moving means to provide access to said pockets, with the second movement means comprising a hinge adjacent one side of the fly to pivotally mount the fly on the press, with said fly being movable between a first position adjacent the first moving means and a second position spaced from the first moving means.

2. The press of claim 1 wherein the first moving means comprises a transport belt, and means for driving the belt.

3. The press of claim 1 including means for directing the articles from the first moving means into the pockets of the fly.

4. The press of claim 3 wherein the directing means comprises a plurality of arcuate shoes extending partially around the fly.

5. The press of claim 1 wherein the receiving and transporting means comprises a belt, and means for moving the belt.

6. The press of claim 1 wherein the fly comprises a plurality of fly wheels secured to the shaft and spaced laterally along the shaft.

7. The press of claim 1 wherein the rotating means includes a pulley and a belt extending around the pulley, and means for retaining the belt on the pulley when the second moving means moves the fly to said position away from the first moving means.

8. The press of claim 1 wherein the second movement means comprises means for permitting movement of the fly away from the receiving and transporting means.

9. The press of claim 1 including means for pinching the articles against the receiving and transporting means.

10. The press of claim 9 wherein the pinching means comprises a plurality of stripper wheels engaged against the receiving and transporting means.

11. A printing press, comprising:

a delivery fly having a plurality of arcuate fingers mounted on a shaft and defining a plurality of pockets extending peripherally around the fly to receive a printed article in the pockets;

means for rotating the fly shaft;

first means for moving the articles to a position adjacent the pockets of the fly for depositing the articles in the pockets;

means for receiving the articles from the pockets of the fly, and for transporting the articles away from the fly; and second means for permitting movement of the fly to a position away from the first moving means to provide access to said pockets, including means for directing the articles from the first moving means into the pockets of the fly, wherein the directing means comprises a plurality of arcuate shoes extending partially around the fly, including means for laterally adjusting the shoes.

12. A printing press, comprising:

a delivery fly having a plurality of arcuate fingers mounted on a shaft and defining a plurality of pockets extending peripherally around the fly to receive a printed article in the pockets;

means for rotating the fly shaft;

first means for moving the articles to a position adjacent the pockets of the fly for depositing the articles in the pockets;

means for receiving the articles from the pockets of the fly, and for transporting the articles away from the fly; and second means for permitting movement of the fly to a position away from the first moving means to provide access to said pockets, including means for pinching the articles against the receiving and transporting means, wherein the pinching means comprises a plurality of stripper wheels engaged against the receiving and transporting means, and wherein the stripper wheels are laterally adjustable.

* * * * *